US011267262B2

(12) United States Patent
Liu

(10) Patent No.: US 11,267,262 B2
(45) Date of Patent: Mar. 8, 2022

(54) PRINTER

(71) Applicant: XIAMEN HANIN ELECTRONIC TECHNOLOGY CO.,LTD., Xiamen (CN)

(72) Inventor: Zhiping Liu, Xiamen (CN)

( * ) Notice: Subject to any disclaimer, the term of this patent is extended or adjusted under 35 U.S.C. 154(b) by 180 days.

(21) Appl. No.: 16/876,253

(22) Filed: May 18, 2020

(65) Prior Publication Data

US 2021/0094326 A1 Apr. 1, 2021

(30) Foreign Application Priority Data

Sep. 30, 2019 (CN) ..... 201921667025.1

(51) Int. Cl.

| | |
|---|---|
| ***B41J 11/04*** | (2006.01) |
| ***B41J 23/02*** | (2006.01) |
| ***B41J 2/33*** | (2006.01) |
| ***B41J 11/44*** | (2006.01) |
| ***B41J 11/51*** | (2006.01) |
| *B41J 2/32* | (2006.01) |
| *B41J 13/10* | (2006.01) |
| *B41J 11/24* | (2006.01) |
| *B41J 2/315* | (2006.01) |

(52) U.S. Cl.

CPC ..... *B41J 11/04* (2013.01); *B41J 2/33* (2013.01); *B41J 11/44* (2013.01); *B41J 11/51* (2013.01); *B41J 23/02* (2013.01); *B41J 2/315* (2013.01); *B41J 2/32* (2013.01); *B41J 11/24* (2013.01); *B41J 13/103* (2013.01)

(58) Field of Classification Search

CPC ..... B41J 11/04; B41J 2/33; B41J 11/44; B41J 11/51; B41J 2/32; B41J 13/103; B41J 11/24; B41J 2/315; B41J 23/02

See application file for complete search history.

(56) References Cited

U.S. PATENT DOCUMENTS 4,812,065 A * 3/1989 Shimogawara ..... B41J 13/103 400/624
5,149,218 A * 9/1992 Iwatani ..... B41J 13/10 271/127
7,306,216 B2 * 12/2007 Lee ..... B65H 3/08 271/10.01

* cited by examiner

*Primary Examiner* — Yaovi M Ameh
(74) *Attorney, Agent, or Firm* — The Law Office Of Austin Bonderer, PC; Austin Bonderer

(57) ABSTRACT

A thermal printer comprises a base part, a platen roller and a thermal head oppositely arranged, a pickup roller, and a gear set connecting the platen roller and the pickup roller. The base part is provided with a printing paper accommodating cavity and a pickup roller mounting frame, a plurality of printing paper sheets are disposed in the printing paper accommodating cavity, and a clutch mechanism is further provided. The clutch mechanism comprises a driving portion driven by the gear set and a driven portion for driving the pickup roller to rotate. The driving portion is disposed outside the pickup roller mounting frame, such that the impact force, which is generated by the remaining printing paper sheet that falls down when the printing paper sheet departs from the pickup roller and which is transmitted to the platen roller, can be reduced. The thermal printer is capable of providing smooth printing.

9 Claims, 4 Drawing Sheets

PRINTER

CROSS-REFERENCE TO RELATED APPLICATIONS

The present application claims the benefit under 35 U.S.C. § 119 of China Patent Application No. 201921667025.1, filed on Sep. 30, 2019, in the China National Intellectual Property Administration, the content of which is hereby incorporated by reference.

FIELD OF THE INVENTION

The present disclosure relates to the technical field of printers, more particularly to a thermal printer capable of providing smooth printing.

BACKGROUND OF THE INVENTION

The pickup roller installed on the printer can be driven by the platen roller via the gear set and rotated therewith. When the pickup roller is rotated, the lowermost one of the loaded printing paper sheets which are in contact with the pickup roller is fed frontward as the rotation of the pickup roller. The printing paper sheets can be fed due to the friction between the printing paper sheets and the circumferential surface of the pickup roller. And then the printing paper sheet is separated from the circumferential surface of the pickup roller at the supporting point of the terminal end of the protruding part of the pickup roller. Then the printing paper sheet falls onto the bottom surface of the printing paper loading part. However, the rear end of the printing paper sheet which is in close contact with the circumferential surface of the pickup roller during the feeding of the printing paper sheet gradually falls off along the circumferential surface. At the moment the printing paper sheet contacts the bottom surface, the remaining printing paper sheet that falls may generate an impact force on the bottom surface of the printing paper loading part. The impact force may be transmitted to the platen roller by the gear set, and a reaction force may be generated by the platen roller for transmission, such that a sloshing may occur at the front end of the printing paper sheet which is printed with an image. The sloshing lead to a deflection of engagement between the platen roller and the thermal head and resulting in poor printing quality.

When the read end of the printing paper sheet is separated from the circumferential surface of the pickup roller and comes in contact with the bottom surface of the paper loading part, an impact force is generated by the remaining printing paper sheet that falls down. The impact force may be transmitted to the platen roller and affects the quality of printing on the printing paper sheet. To alleviate such problem, the present disclosure is provided.

SUMMARY OF THE INVENTION

The present disclosure provides a thermal printer which can alleviate the problem of the impact force that is generated by the remaining printing paper sheet that falls and is transmitted to the platen roller, which affects the quality of printing on the printing paper sheet and capable of providing smooth printing.

To this end, the present disclosure provides a printer which comprises a base part, a gear set, a platen roller, a pickup roller, and a thermal head. The base part defines a printing paper accommodating cavity configured to accept printing paper sheets and comprises a pickup roller mounting frame. The platen roller and the thermal head are oppositely arranged, and the platen roller and the pickup roller are coupled by the gear set. A clutch mechanism is further provided, which comprises a driven portion and comprises a driving member driven by the gear set. The driving member comprises a driving portion, and the driving portion is configured for driving the driven portion to rotate in such a manner that the driven portion drives the pickup roller to rotate. The pickup roller is supported on the pickup roller mounting frame. On contrast, the driving member is supported by a part different from the pickup roller mounting frame. In such a manner, an impact force, which is transmitted to the platen roller by remaining printing paper sheet that falls down when the printing paper sheet departs from the pickup roller, is reduced.

In some embodiments, the clutch mechanism is arranged coaxially with a rotation shaft of the pickup roller.

In some embodiments, the clutch mechanism comprises a driving member and a driven member. The driven member is fixedly sleeved on the rotation shaft of the pickup roller and is rotatably and fixedly supported on the pickup roller mounting frame together with the rotation shaft of the pickup roller.

In some embodiments, the driving member is arranged at one end with a gear portion engaged with the gear set and at another end with the driving portion.

In some embodiments, the clutch mechanism is coaxially arranged on the rotation shaft of the pickup roller, and the driven member is rotated along with the rotation shaft of the pickup roller, and the driving member is rotatably sleeved on the rotation shaft of the pickup roller.

In some embodiments, the driving portion and the driven portion have an idle segment.

In some embodiments, a linear velocity of the printing paper sheet transmitted at the platen roller is greater than a linear velocity of the printing paper sheet transmitted at the pickup roller. When the printing paper sheet is fed frontward to the platen roller by means of the pickup roller, the pickup roller is driven to rotate by the printing paper sheet until the printing paper sheet is separated. The driven portion enters into an idle state to reduce a sloshing of the platen roller that is caused when the printing paper sheet departs from the pickup roller.

In some embodiments, the pickup roller mounting frame is arranged at the bottom of the base part, and the pickup roller is arranged at the pickup roller mounting frame and protrudes towards the printing paper accommodating cavity.

In some embodiments, the driven portion is arranged on a rotation shaft of the pickup roller.

The technical solution of the present disclosure has advantages as follows.

1. In the case that an impact force may be generated by the remaining printing paper sheet that falls when the printing paper sheet departes from the pickup roller, with the arrangement that the driving member is not directly supported by the pickup roller mounting frame, the impact force which is transmitted by the pickup roller when the printing paper sheet falls down and which directly affects the driving portion can be reduced, and the impact force which is transmitted to the platen roller by the gear set and which may lead to a shaking of the platen roller can be reduced, whereby effect on the printing quality can be reduced.

2. Since the linear drive velocity of the platen roller is greater than the linear drive velocity of the pickup roller. Thus, when printing paper sheet is transmitted to the platen roller, the pickup roller is driven to rotate by the friction force generated between the printing paper sheet and the pressing portion disposed on the printing paper sheet, such that the driving portion of the clutch mechanism can be parted from the driven member. Thus it avoids the instantaneous momentum which is generated when the printing paper sheet departs from the circumferential surface of the pickup roller, and which may be applied on the platen roller to affect the printing effect.

DETAILED DESCRIPTION OF ILLUSTRATED EMBODIMENTS

In order to make the purpose, technical solution and advantages of embodiments of the present disclosure more clear, the embodiments of the present disclosure will be described more completely and clearly below in conjunction with the accompanying drawings illustrating the embodiments. It is apparent that the embodiments described below are merely some, but not all, embodiments of the present disclosure. Based on the embodiments of the present disclosure, those skilled in the art may obtain other embodiments included within the scope of the present disclosure without any creative work. Therefore, the detailed description of embodiments of the present disclosure illustrated in the accompanying drawings is not intended to limit the scope of the disclosure, but rather illustrates particular embodiments of the present disclosure. Based on the embodiments of the present disclosure, those skilled in the art may obtain other embodiments included within the scope of the present disclosure without any creative work.

Figure 1:
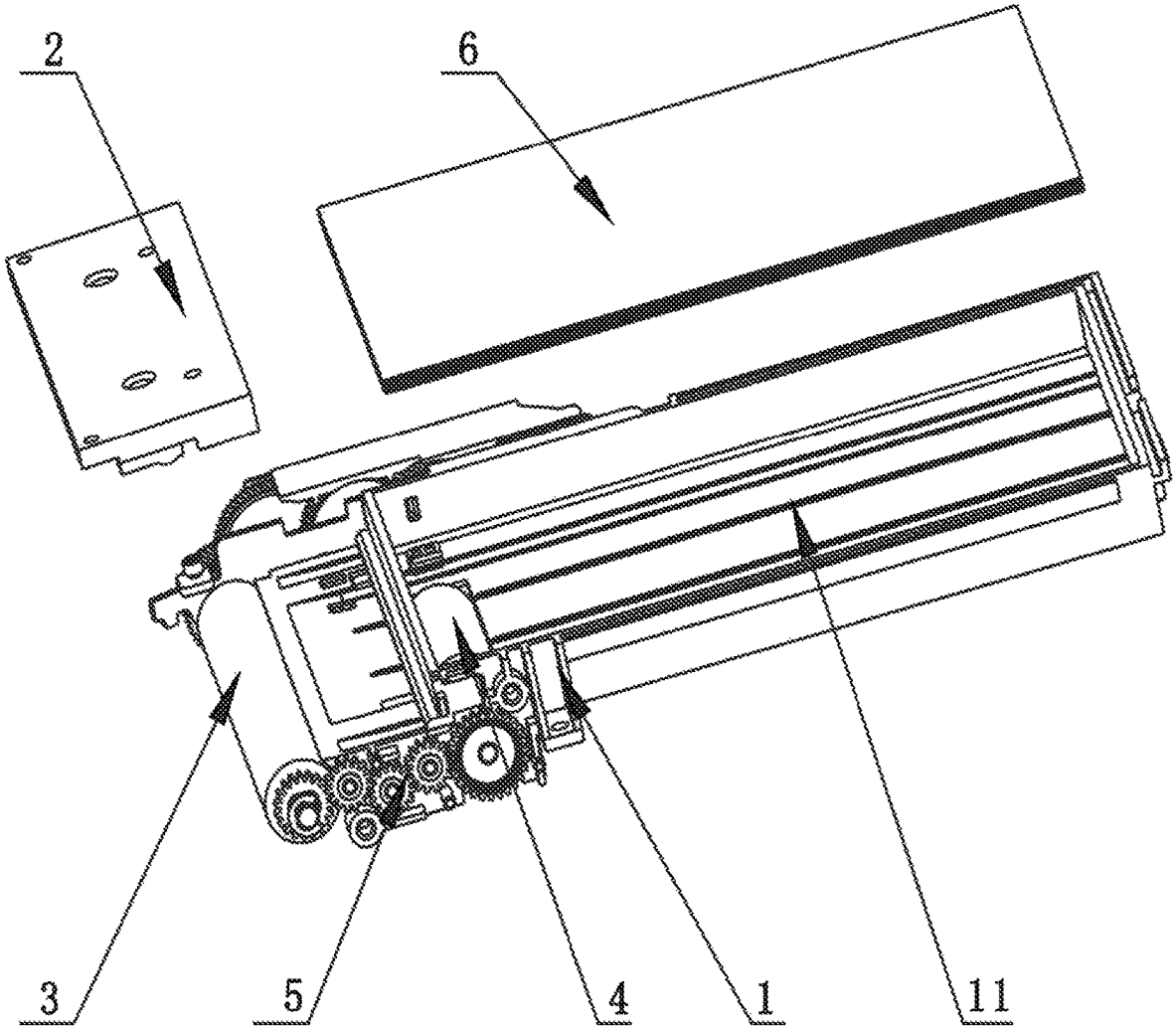
FIG. 1 is an exploded view of the present disclosure.
Figure 2:
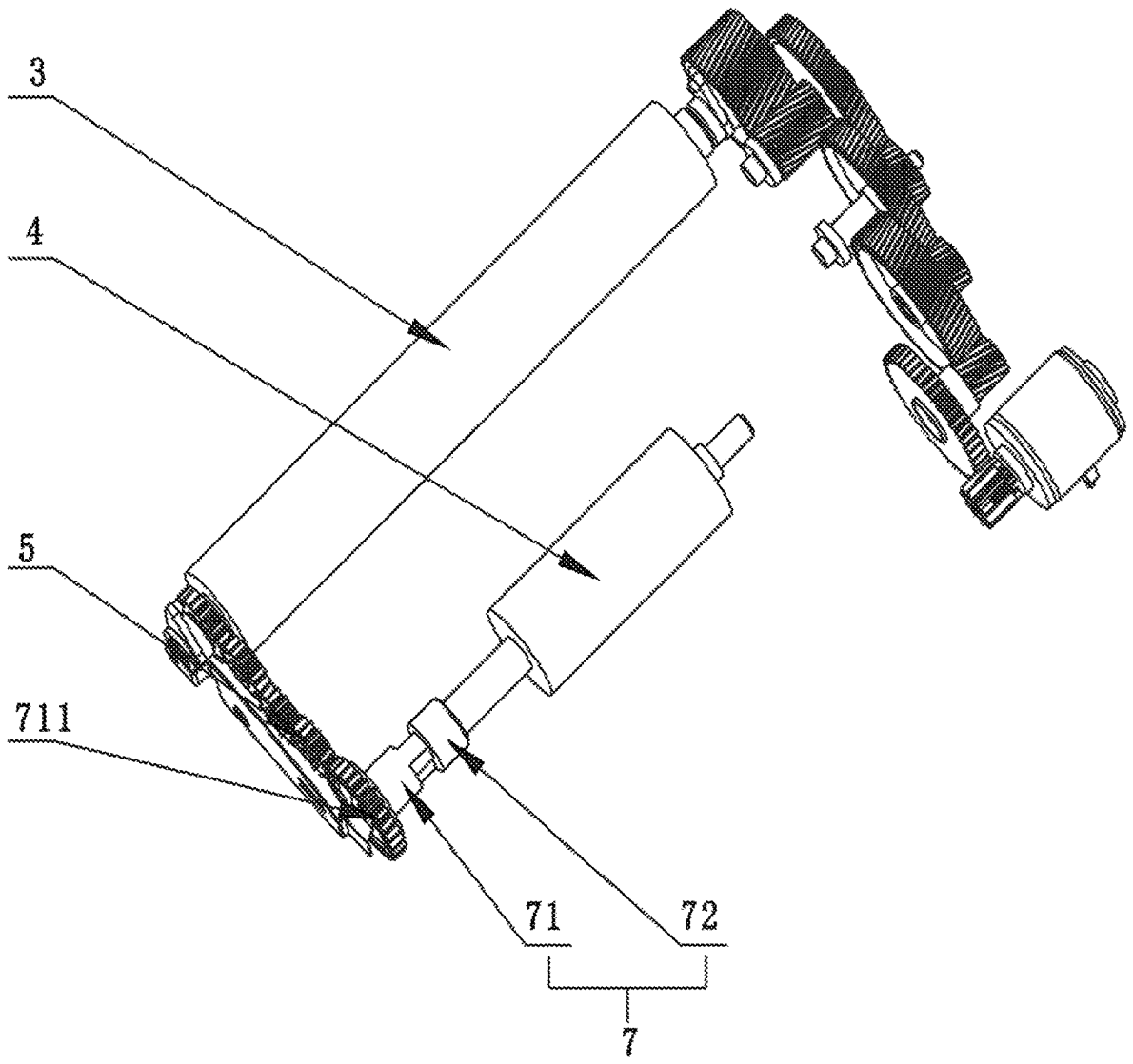
FIG. 2 is a schematic view illustrating a connection of a platen roller, a gear set, a clutch mechanism, and a pickup roller of the present disclosure.
Figure 3:
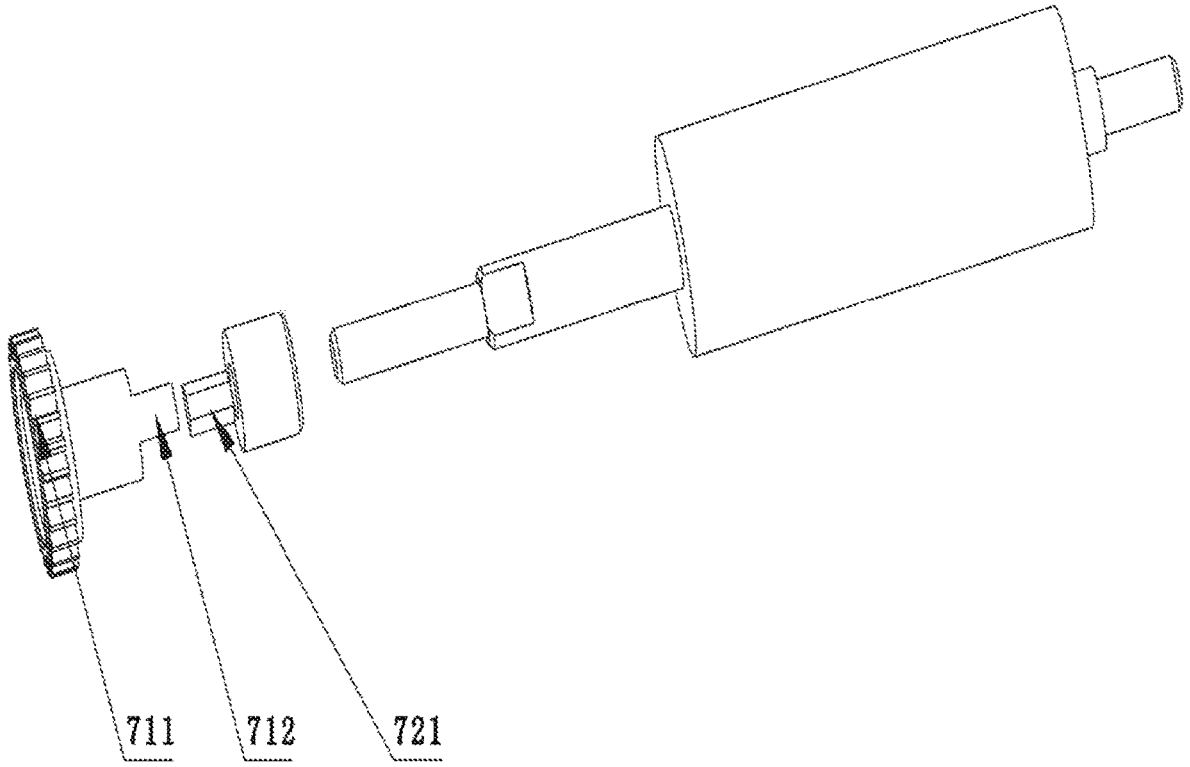
FIG. 3 is an exploded view of a clutch mechanism according to the present disclosure.
Figure 4:
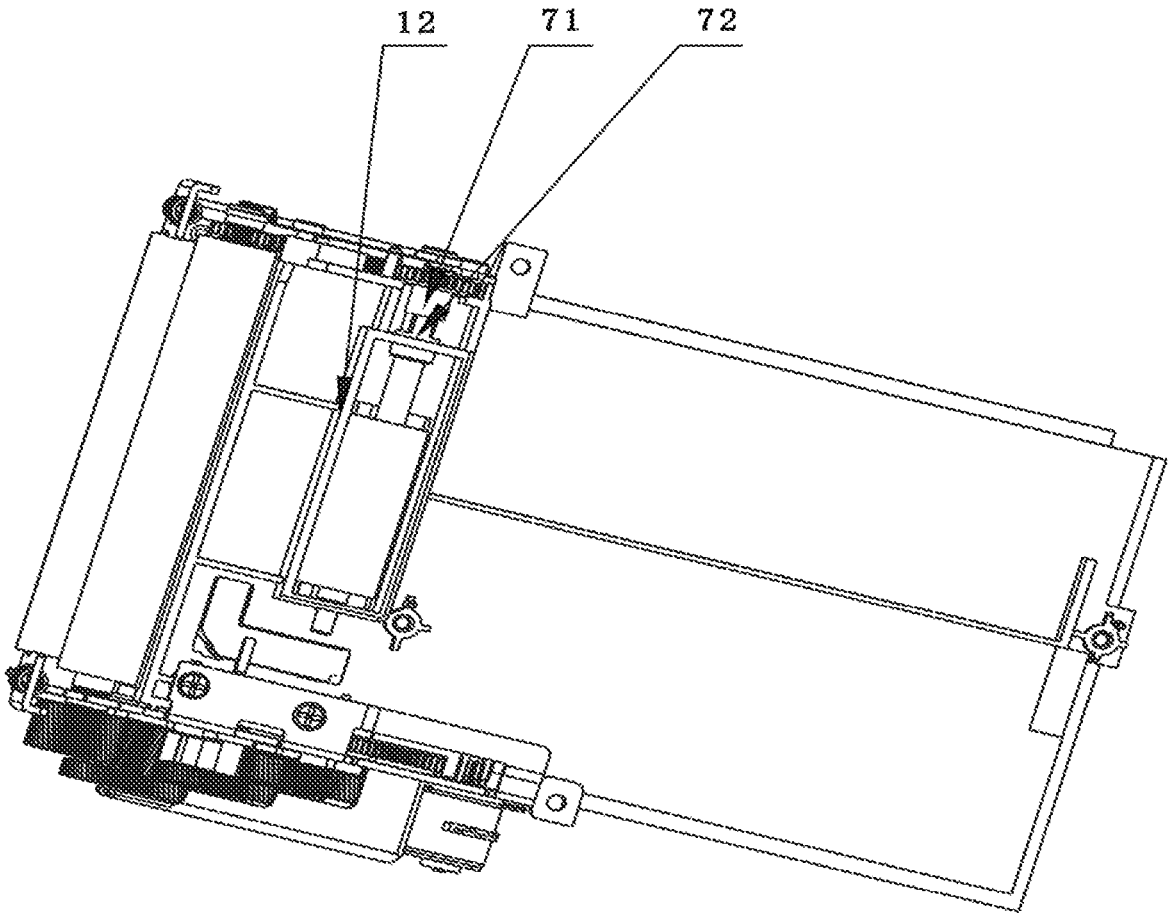
FIG. 4 is a schematic view of the present disclosure from a first perspective.
Figure 5:
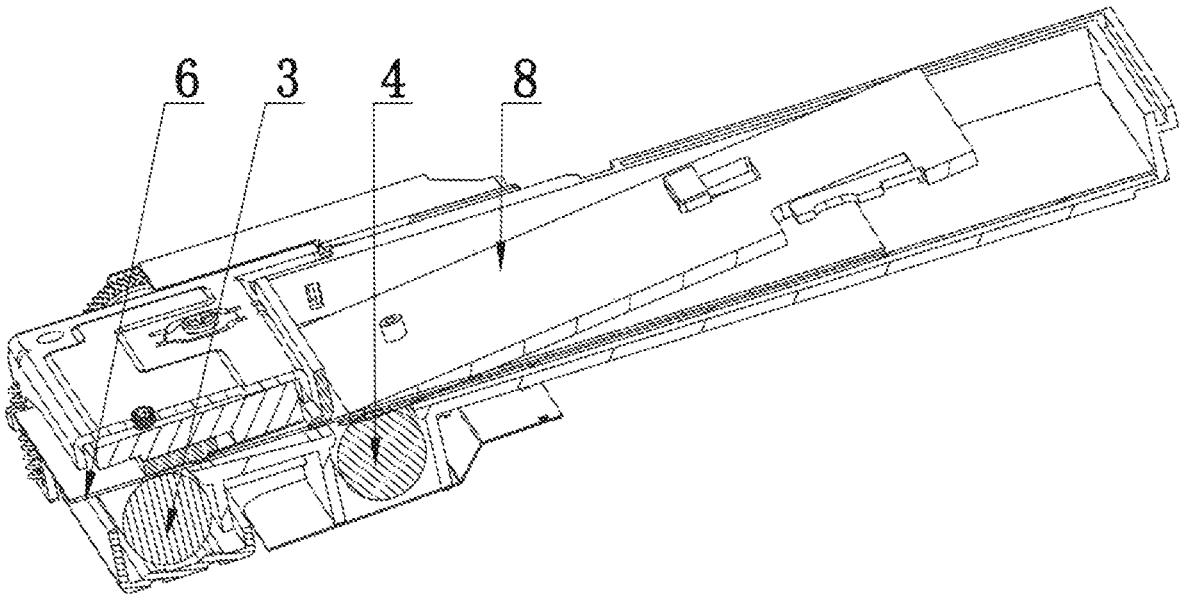
FIG. 5 is a sectional view taken along a midline according to the present disclosure.

Referring to FIGS. 1-5, a thermal printer capable of providing smooth printing in a first embodiment according to the present disclosure comprises a base part 1, a platen roller 3, a thermal head 2, a pickup roller 4, a gear set 5, a pressing portion 8, and a clutch mechanism 7. The base part 1 comprises with a printing paper accommodating cavity 11 and a pickup roller mounting frame 12 for mounting the pickup roller 4. A plurality of printing paper sheets 6 can be disposed in the printing paper accommodating cavity 11. The pressing portion 8 can be disposed on the plurality of printing paper sheets 6 and press the printing paper sheets 6 in a direction towards the bottom of the printing paper accommodating cavity 11, such that a friction force can be generated during the feeding process of the printing paper sheets 6. Thus the printing paper sheets 6 can be fed frontward. The pickup roller 4 is arranged at the front end of the printing paper accommodating cavity 11. The pickup roller mounting frame 12 is arranged at the bottom portion of the base part 1. The pickup roller 4 is arranged on the pickup roller mounting frame 12 and protrudes towards the printing paper accommodating cavity 11. Due to the transmission of the pickup roller 4 and the pressure of the pressing portion 8, one of the printing paper sheets 6 which is in close contact with the pickup roller 4, can be fed frontward. In the case that the pickup roller 4 is in contact with the lowermost one of the plurality of printing paper sheets 6, the lowermost one of the printing paper sheets 6 can be fed frontward by the rotation of the pickup roller 4.

The pickup roller mounting frame 12 may also be provided as a hollow mounting cavity provided on the printing paper accommodating cavity 11.

The platen roller 3 and the thermal head 2 are oppositely disposed at the front end of the printer. The printer is arranged with a driving device for driving the platen roller 3 to rotate. The printing paper sheet 6 transmitted from the pickup roller 4 can be printed with text or images when it is clamped between the platen roller 3 and the thermal head 2, and then it can be discharged as the rotation of the platen roller 3.

A gear set 5 may be arranged between the platen roller 3 and the pickup roller 4 to achieve connection there-between. By means of the gear set 5, the pickup roller 4 can be driven to perform transmission by the platen roller 3. The gear set 5 may function as a speed-reduction device.

A clutch mechanism 7 may be further arranged between the gear set 5 and the pickup roller 4. The clutch mechanism 7 may be arranged coaxially with the rotation shaft of the pickup roller 4. The clutch mechanism 7 may comprise a driving member 71 and a driven member 72. The driven member 72 is fixedly sleeved on the rotation shaft of the pickup roller 4 and supported on the pickup roller mounting frame 12. The rotation shaft of the pickup roller 4 may be provided with a cutting plane, and the driven member 72 may be provided with a connecting plane corresponding to the cutting plane. Alternatively, the rotation shaft of the pickup roller 4 may be provided with a keyway, which can be engaged with the driven member 72 utilizing a key, such that both the rotation shaft of the pickup roller 4 and the driven member 72 can be rotatably and fixedly supported on the pickup roller mounting frame 12 for the pickup roller 4. The driving member 71 is arranged at one end with a gear portion 711 engaged with the gear set 5 and at another end with the driving portion 712.

The clutch mechanism 7 may comprise a driving portion 712 driven by the gear set 5 and a driven portion 721 for driving the pickup roller 4 to rotate. The driving portion 712 and the driven portion 721 are arranged radially along the rotation shaft of the pickup roller 4. Both the driving portion 712 and the driven portion 721 are formed as a square block having a certain radian, and the sum of the two radians is less than 360°. Preferably, the sum of the two radians is 300°, and the driving portion 712 and the driven portion 721 each have a radian of 30°. Due to the designs of the driving portion 712 and the driven portion 721, the driving portion 712 and the driven portion 721 may have idle travel during the rotation. During the printing process, with the linear velocity of the printing paper sheet 6 transmitted at the platen roller 3 being greater than the linear velocity of the printing paper sheet 6 transmitted at the pickup roller 4, the impact on the printing caused by the velocity difference can be eliminated by the idle travel. In the present embodiment, the driving portion 712 and the driven portion 721 have idle travel, and the angle of the idle travel is greater than the rotation angle of the driven portion 721 caused by the velocity difference. Since the gear set 5 functions as a speed-reduction device, in the case that the gear set 5 driven by the platen roller 3 drives the pickup roller 4 to rotate, the rotational velocity of the platen roller 3 is greater than the rotational velocity of the pickup roller 4. The linear velocity of the printing paper sheet 6 transmitted by the platen roller 3 is greater than the linear velocity of the printing paper sheet 6 transmitted by the pickup roller. When the printing paper sheet 6 is fed frontward to the platen roller 3 by means of the pickup roller 4, the platen roller 3 can drive the pickup roller 4 to rotate by means of the printing paper sheet 6 until the printing paper sheet 6 is separated from the pickup roller 4. When the printing paper sheet 6 drives the pickup roller 4 to rotate, the rotational velocity of the driven portion 721 equals to the rotational velocity of the platen roller 3. In contrast, the driving portion 712 driven by the platen roller 3 via the speed-reduction device is rotated at a velocity less than the rotational velocity of the driven portion 721. Hence, the driven portion 721 begins the idle movement and the driven portion 721 is gradually moved away from the driving portion 712. In order to prevent the driven portion 721 performing the idle movement from hitting the driving portion 712 and affecting the transmission of the gear set 5 after rotating more than a certain number of revolutions, it is necessary to make sure that the driven portion 721 will not hit the driving portion 712 when the pickup roller 4 is driven to rotate by the platen roller 3 utilizing the printing paper sheet 6 until the printing paper sheet 6 is separated from the pickup roller 4. When the printing paper sheet 6 departs from the pickup roller 4, a frontward instantaneous momentum will be generated, which may be transmitted to the driving member 71 by the driven member 72 disposed in the rotation shaft of the pickup roller 4 and then transmitted to the platen roller 3 by the gear set 5, thereby resulting in shaking of the platen roller 3 and affecting the printing quality. In such case, due to the separation of the driven member 72 from the driving member 71 of the clutch mechanism 7, a direct impact on the gear set 5 is reduced. Thus the shaking of the platen roller 3 is reduced. In the case that an instantaneous momentum of the printing paper sheet 6 is generated when the printing paper sheet 6 departs from the circumferential surface of the pickup roller 4. It prevents the instantaneous momentum from being directly applied to the platen roller 3 by the gear set 5 due to the reaction. And avoids affecting the printing of the thermal head 2 for printing on the printing paper sheet 6.

The impact force is generated by the remaining printing paper sheet that falls on the pickup roller when the lowermost one of printing paper sheets departs from the pickup roller.

To effectively reduce the impact force which may affect the printing effect, a pickup roller mounting frame 12 may be arranged at the bottom of the printing paper accommodating cavity 11. The driving portion 712 may be arranged outside the pickup roller mounting frame 12 for the pickup roller 4. Since the driving portion 712 is disposed outside the pickup roller mounting frame 12, when the impact force is applied on the pickup roller mounting frame 12, the impact force transmitted to the driving portion 712 can be reduced or omitted. In this way, the momentum transmitted to the platen roller 3 by the gear set 5 is minimal and would not lead to shaking, which may affect the printing. In particular, the pickup roller mounting frame 12 does not directly support the driving member 71. Thus, when the remaining printing paper sheet 6 falls as the printing paper sheet 6 departs from the pickup roller 4, the impact force which may be transmitted to the platen roller 3 can be reduced. Alternatively, the driving member 71 may be supported on the pickup roller mounting frame 12 via a buffering part. Due to the buffering part, the impaction of the driving member 71 to the pickup roller mounting frame 12 can be reduced.

The operation of the embodiment according to the present disclosure is described below.

Firstly, the protruding part of the pickup roller 4, which is arranged at the printing paper accommodating cavity 11, abuts against the plurality of printing paper sheet 6 in the printing paper accommodating cavity 11. The platen roller 3 drives the gear set 5 in such a manner that the gear set 5 drives the pickup roller 4 to rotate. When the driving portion 712 of the driving member 71 comes in contact with the driven portion 721 of the driven member 72 and drives the driven portion 721 to rotate, the driven portion 721 drives the pickup roller 4 to rotate. At this time, the lowermost one of the plurality of printing paper sheets 6 is driven by the pickup roller 4 and is feed frontward along the circumferential surface of the pickup roller 4. When the printing paper sheet 6 is fed to the platen roller 3, the printing paper sheet 6 which is driven by the platen roller 3 can drive the pickup roller 4 to rotate. In such a case, the drive speed of the driven portion 721 is greater than the drive speed of the driving portion 712, the driven portion 721 has an idle segment and the driven member 72 and driving member 71 are separated. Thus, the frontward instantaneous momentum, which is generated when the rear end of the printing paper sheet 6 departs from the pickup roller 4, will not transmitted to the driving member 71. Thus, in such a case, the impact applied on the driving member 71 is merely transmitted from the rotation shaft of the pickup roller 4 and thus is small. In such a case, the impact force is transmitted to the pickup roller mounting frame 12 by the rotation shaft of the pickup roller 4. Since the driving member 71 is not directly supported by the pickup roller mounting frame 12, the impact force transmitted to the driving portion 712 by the pickup roller is reduced. Thus, the impact force transmitted to the gear set 5 by the driving member 71 and thus transmitted to the platen roller 3 is reduced, thereby avoiding affect the printing quality. After that, a short stop of the pickup roller 4 occurs, which stops the feeding of the paper sheet, and the driven member 72 is stopped. On contrast, the driving member 71 driven by the gear set 5 continues to rotate and has idle movement until the driving member 71 comes in contact with the driven member 72 again. Then, the pickup roller 4 is driven to rotate and continues feeding the printing paper sheet 6.

With the above actions, the problem that the impact force applied on the platen roller 3 affects the printing quality can be alleviated. Also, due to the clutch mechanism 7, the pickup roller 4 has idle travel during the feeding of each printing paper sheet 6, whereby the problem that the printing paper sheet 6 affects the platen roller 3 when it departs from the pickup roller 4 can be alleviated, and smooth printing can be achieved.

Second Embodiment

In the second embodiment, the clutch mechanism 7 may be arranged coaxially with the rotation shaft of the pickup roller 4, and the driven member 72 may be rotated along with the rotation shaft of the pickup roller 4. Preferably, the driven member 72 may be integrally formed with the rotation shaft of the pickup roller 4. The driving member 71 may be rotatably sleeved on the rotation shaft of the pickup roller 4. Others are similar to those arrangements in the first embodiment and are not repeated here.

The above is only some embodiments of the present disclosure and is not intended to limit the present disclosure. To those of ordinary skill in the art, various modifications and changes can be made to the present disclosure. Any modifications, equivalent substitutions, improvements, etc.

made within the spirit and scope of the present disclosure are intended to be included within the scope of the present disclosure.

What is claimed is:

1. A printer, comprising: a base part, a gear set, a pickup roller, a platen roller, and a thermal head; wherein, the base part defines a printing paper accommodating cavity that is configured to accept printing paper sheets, and comprises a pickup roller mounting frame;

the platen roller is disposed opposite the thermal head;

the pickup roller and the platen roller are coupled by the gear set; and a clutch mechanism comprising a driven portion and comprising a driving member driven by the gear set, wherein the driving member comprises a driving portion, and the driving portion is configured for driving the driven portion to rotate in such a manner that the driven portion drives the pickup roller to rotate; and the pickup roller is supported on the pickup roller mounting frame, and the driving member is supported by a part different from the pickup roller mounting frame, such that an impact force, which is transmitted to the platen roller by remaining printing paper sheet that falls down when the printing paper sheet departs from the pickup roller and which is transmitted to the platen roller, is reduced.

2. The printer according to claim 1, wherein the clutch mechanism is arranged coaxially with a rotation shaft of the pickup roller.

3. The printer according to claim 2, wherein the clutch mechanism also comprises a driven member, the driven member is fixedly sleeved on the rotation shaft of the pickup roller and is rotatably and fixedly supported on the pickup roller mounting frame together with the rotation shaft of the pickup roller.

4. The printer according to claim 3, wherein the driving member is arranged at one end with a gear portion engaged with the gear set and at another end with the driving portion.

5. The printer according to claim 3, wherein the clutch mechanism is coaxially arranged on the rotation shaft of the pickup roller; and the driven member is rotated along with the rotation shaft of the pickup roller, and the driving member is rotatably sleeved on the rotation shaft of the pickup roller.

6. The printer according to claim 1, wherein the driving portion and the driven portion have an idle segment.

7. The printer according to claim 6, wherein, the gear set is configured to be a speed-reduction device such that the linear velocity of the printing paper sheet transmitted at the platen roller is greater than the linear velocity of the printing paper sheet transmitted at the pickup roller; and when the printing paper sheet is fed frontward to the platen roller by means of the pickup roller, the pickup roller is capable of being driven to rotate by the printing paper sheet until the printing paper sheet is separated, and the driven portion enters into an idle state to reduce a sloshing of the platen roller that is caused when the printing paper sheet departs from the pickup roller.

8. The printer according to claim 1, wherein the pickup roller mounting frame is arranged at the bottom of the base part, and the pickup roller is arranged at the pickup roller mounting frame and protrudes towards the printing paper accommodating cavity.

9. The printer according to claim 1, wherein the driven portion is arranged on a rotation shaft of the pickup roller.

* * * * *